United States Patent [19]

Clauss

[11] 4,314,893

[45] Feb. 9, 1982

[54] PRODUCTION OF MULTIPLE ZINC-CONTAINING COATINGS

[75] Inventor: Richard J. Clauss, Allen Park, Mich.

[73] Assignee: Hooker Chemicals & Plastics Corp., Warren, Mich.

[21] Appl. No.: 122,203

[22] Filed: Feb. 19, 1980

Related U.S. Application Data

[63] Continuation-in-part of Ser. No. 911,861, Jun. 2, 1978, Pat. No. 4,216,272, which is a continuation-in-part of Ser. No. 758,982, Jan. 13, 1977, abandoned.

[51] Int. Cl.[3] ..... C25D 5/10

[52] U.S. Cl. ..... 204/40; 428/658; 428/659

[58] Field of Search ..... 204/40, 41; 427/406; 428/632, 658, 659

[56] References Cited

U.S. PATENT DOCUMENTS

| | | | |
|---|---|---|---|
| 308,447 | 11/1884 | Tucker | 427/406 |
| 1,468,905 | 9/1923 | Herman | 428/659 X |
| 1,984,335 | 12/1934 | Crapo | 428/659 X |
| 3,078,555 | 2/1963 | McFarland | 427/406 X |
| 3,190,768 | 6/1965 | Wright | 428/659 |
| 3,383,189 | 5/1968 | Sendzimir | 427/406 X |
| 3,420,754 | 1/1969 | Roehl | 428/659 X |
| 4,059,711 | 11/1977 | Mino et al. | 428/659 X |
| 4,064,320 | 12/1977 | Adaniya et al. | 428/632 |

FOREIGN PATENT DOCUMENTS

| | | | |
|---|---|---|---|
| 305204 | 6/1971 | U.S.S.R. | 204/40 |

*Primary Examiner*—G. L. Kaplan
*Attorney, Agent, or Firm*—Richard P. Mueller

[57] ABSTRACT

Markedly superior corrosion protective properties are imparted to metal-bearing surfaces at substantially reduced costs by depositing upon said surfaces one or more superimposed coatings containing zinc alloying elements located intermediate the metal-bearing surfaces and a sacrificial layer of generally pure zinc. In this manner penetration of rust inducing substances into the metal bearing surfaces is effectively precluded under substantially all environmental conditions normally encountered.

4 Claims, No Drawings

PRODUCTION OF MULTIPLE ZINC-CONTAINING COATINGS

RELATED CASES

This application is a continuation-in-part of application Ser. No. 911,861 filed June 2, 1978, now U.S. Pat. No. 4,216,272 which application is a continuation-in-part of application Ser. No. 758,982 filed Jan. 13, 1977, now abandoned.

BACKGROUND OF THE INVENTION

It is known in the art to which this invention pertains to provide upon steel, iron or related metal-bearing surfaces an electrodeposited essentially pure zinc coating for corrosion protection purposes. It is conventional in the electrochemical deposition of a zinc coating upon a steel substrate, subsequent to cleaning, rinsing and acid pickeling, to plate from a cyanide zinc bath, and after rinsing, to provide upon the zinc plated surface a passive film in the form of a chromate salt. This may of course take various forms, such as a clear-like coating which resembles nickel, or various textures and colors which assume the appearance of olive drab or colored zinc. However, experience has well indicated that under exposure to known salt spray and humidity environments, or to a locale in which there is a constant salt spray of high salt concentrations coupled with high humidity, the zinc layer under such conditions is penetrated into the steel substrate, and rust or other undesirable conditions are manifest. It has been proposed in order to overcome these difficulties that the zinc coating be increased in thickness; however, while a modest improvement has been noted in the area of corrosion protection, the final product obtained after relatively long exposure to an industrial or marine environment is generally not completely acceptable after lengthy service periods.

SUMMARY OF THE INVENTION

It has now been discovered by applicant that substantial cost economies may be effected not only through material savings, and in accordance with one aspect of the invention additionally by a reduction in the processing steps, while at the same time markedly improving the resistance of the metal-bearing surface to corrosion-inducing substances by depositing upon the metal-bearing surface a plurality of layers of zinc and/or alloys thereof in which the alloying elements may be nickel, cobalt, or iron or mixtures thereof, the initial layer deposited on the metal-bearing surface having an alloy content not substantially greater than about 15% nickel, iron or cobalt, and the layer immediate thereto having an alloy content of from between about zero to markedly less than the maximum alloy content of said initial layer.

These important improvements over the prior art approaches may be achieved by proceeding in the following manner. In one embodiment thereof, the invention may be practiced by providing upon a steel, iron or related substrate presenting a metal-bearing surface a "duplex" type coating comprising on the substrate an initial layer of nickel-zinc, cobalt-zinc or iron-zinc which is followed by a conventional zinc deposit. As will be apparent from the more detailed description of the invention now to follow, the alloy layer may have a total thickness as low as about 0.05 mils and the conventional zinc deposit approximately the same thickness.

This is quite in contrast to the prior art in which a zinc deposit is solely utilized, having generally a greater thickness, and even then corrosion problems present themselves under normal environments to which the coated substrate is exposed. As one explanation for the novel results achieved when the initial layer is a zinc alloy deposit, the alloy deposit appears to be less electrochemically corrodable than zinc alone, and accordingly, the zinc coating dissolves preferentially to the zinc alloy layer, and thereby delays penetration of corrosion-inducing substances to the steel or iron substrate. To be more specific, a deposit which is essentially pure zinc or has a relatively high zinc content is anodic to both the zinc alloy which has a relatively lower zinc content and also to the substrate, such as steel or iron. This appears to explain why the outermost layer or layers relatively high in zinc content corrode preferentially and thereby delay the penetration action to the substrate.

The plating procedure described immediately hereinabove does, however, require the use of two separate electroplating solutions. This possible disadvantage in certain types of installations may be overcome by the now to be described additional embodiment of this invention. This is accomplished by the deposition of alternate coatings having varying alloy compositions from a single solution by the novel technique of changing the agitation of the electrolyte solution. Stated briefly, a coating of relatively high nickel, cobalt or iron content alloyed with zinc is deposited followed by a coating of relatively lower alloy content, each of these being deposited from a single solution and thereby greatly simplifying the entire electrodeposition process. In effect, the novel results of this invention are achieved by employing only one solution in contrast to two separate plating baths as earlier described. As will now be appreciated, many layers of different alloy compositions may be deposited in relatively close time sequence from a single solution by variable agitation. If desired, the uppermost layer may have its alloy content so precisely controlled that for practical purposes the final electrodeposit is essentially zinc. In this manner, it is possible for certain applications to entirely eliminate the overcoat of what is regarded in the art as an essentially pure layer. In any event, regardless of the particular manner in which the novel concepts of this invention are practiced, it has been found that the initial layer electrodeposited on the metal-bearing surface should have an alloy content not substantially greater than about 15% of nickel, iron or cobalt, and that the layer immediate thereto should have an alloy content which varies from about zero to markedly less than the maximum alloy content of the initial layer. In this manner, the mentioned material and production economies are effected, and the possibility of corrosion penetration rendered substantially remote.

It is also within the contemplation of this invention that improvements may be achieved in the resistance of a metal-bearing surface to corrosion-inducing substances by applying to the surface through spraying techniques one or more superimposed coatings containing zinc alloying elements located intermediate the metal-bearing surface and a specified layer of generally pure zinc, the latter of which may be deposited by spraying, painting or electroplating methods. Preferred spraying techniques relating to the novel concepts of this invention will be disclosed in detail hereinafter.

DESCRIPTION OF THE PREFERRED EMBODIMENT

In order to more fully appreciate the named advances made by applicant over the discussed prior art structures and procedures, there is set forth herinbelow a number of zinc-containing formulations, deposition methods, and test data results obtained when coated specimens were exposed to known salt spray and humidity environments and also two conditions in which there was a constant salt spray of high salt concentrations coupled with high humidity. First, there was formulated a zinc sulfate solution which functioned both as a control in the production of prior art substantially pure zinc coatings, and also as a superimposed electroplate upon a zinc alloy deposit in which the alloying element was either nickel, iron or cobalt. This formulation is disclosed in the example now to follow.

EXAMPLE I 1800 mils of a zinc sulfate solution was prepared from a composition which contained 216 grams $ZnSO_4.H_2O$, 69 grams $H_3BO_3$, 36 grams $(NH_4)_2SO_4$, and 18 grams sodium gluconate. This solution was filtered after preparation using a small amount of filter aid and the pH was adjusted to 5.4. Air agitation was employed.

EXAMPLE II

A zinc-nickel solution was prepared having the following composition:

| | |
|---|---|
| $ZnSO_4 . H_2O$ | 130 g/l |
| $NiCl_2 . 6H_2O$ | 153 g/l |
| $H_3BO_3$ | 15 g/l |
| $(NH_4)_2SO_4$ | 20 g/l |

The above solution was maintained at a temperature between 75° and 80° F. and had a pH of about 4.5. Utilizing this solution, the nickel content in the alloy obtained was approximately 9.2%. No agitation was employed.

EXAMPLE III

| | |
|---|---|
| $ZnCl_2$ | 65 g/l |
| $NiCl_2 . 6H_2O$ | 120 g/l |
| $NH_4Cl$ | 160 g/l |
| $NaC_2H_3O_2$ | 6 g/l |

This formulation was maintained during preparation at between 65° and 85° F., and had a pH of between 5 and 5.5. The alloy deposit obtained therefrom had a nickel content of about 13.3%. Agitation was not employed.

EXAMPLE IV

| | |
|---|---|
| $ZnSO_4 . H_2O$ | 30 g/l |
| $NiCl_2 . 6H_2O$ | 210 g/l |
| $(NH_4)_2SO_4$ | 20 g/l |
| $H_3BO_3$ | 45 g/l |

This particular solution was maintained at a temperature of between 75° and 80° F. and had a pH of about 5 to 5.5. The alloy deposit obtained therefrom had a nickel content of about 19.8%. No agitation was used.

To illustrate the invention further, 1800 mils of a zinc-iron solution was prepared with the following composition:

EXAMPLE V

| | |
|---|---|
| $FeCl_2 . 4H_2O$ | 126 g/l |
| $ZnCl_2$ (774 g/l) | 21 ml |
| $H_3BO_3$ | 69 g/l |
| KCl | 36 g/l |
| sodium gluconate | 18 g/l |

This solution was filtered using a small amount of filter aid and the pH was adjusted to about 3.7 using 10% NaOH. The solution temperature was about 75° to 80° F., and agitation was employed.

It has been stated earlier that the objectives of this invention can be achieved when the element alloyed with zinc is cobalt. An exemplary formulation was prepared having the composition as follows:

EXAMPLE VI

| | |
|---|---|
| $ZnSO_4 . H_2O$ | 60 g/l |
| $CoCl_2$ | 90 g/l |
| $H_3BO_3$ | 45 g/l |
| $NH_4Cl$ | 20 g/l |

The solution temperature was maintained at 75° to 80° F., the pH was about 2.5 to 3.0, and no agitation was used.

The majority of the formulations set forth above, subsequent to electroplating upon steel panels having linear dimensions of approximately 4 inches by 6 inches, were subjected to neutral salt spray tests and also prolonged exposure to a corrosive environment such as is present at Kure Beach, N.C. In rating the results of these tests, the procedure of ASTM Standard B537 was followed.

In preparation for the first series of salt spray tests, control panels were plated with the solution of Example I above for 10 minutes at 3.5 amperes (about 25 ASF) with air agitation. A second set of steel panels were first plated with the formulation of Example V, previously referred to, for 5 minutes at 3.5 amperes with air agitation, with rinsing, and thereafter plated for about 5 minutes at 3.5 amperes with air agitation from a solution of the type shown in Example I. Also in preparation for neutral salt spray testing, a third set of steel panels using the formulation of Example V was plated for approximately 2½ minutes with no air agitation, 2½ minutes with air agitation, 2½ minutes with no air agitation, and 2½ minutes with air agitation. This provided a multi-layer deposit with varying iron contents, and when air agitation was used, the iron content in the alloy was approximately 5 to 7%.

The results obtained with the specimens described above were electroplated and exposed to a 5% neutral salt spray environment in accordance with ASTM Standard B117 are set forth below in Table A. It ma be noted therefrom that the specimens were observed after periods of 24, 44 and 68 hours, and the legend "WCP" refers to a white corrosion deposit, as is known to the art. The specimens designated "zinc plated control" had a thickness of about 0.2 mils, and the other specimens a total plated thickness of approximately 0.2 mils.

Other specimens were prepared substantially as above described, and the salt spray test results appear in Table B below. In this table, the systems designated as zinc deposit employ the general formulation of Example I, and the multi-layer specimens used variations of compositions above set forth in Examples II and III. Blank spaces in the chart indicate that no observations were made at that particular time.

It may be seen from a review of the data presented in Tables A and B that panels of steel or an iron-based alloy when electroplated in accordance with the novel concepts of this invention significantly out-performed panels which carried solely a zinc coating of the same thickness. It is quite clear from this that material economies are effected, and a superior product is obtained.

Of even greater significance is the comparative corrosion exposure data now to be presented. All tests were performed at a marine test site at Kure Beach, N.C., which is an environment characterized by constant salt spray of high salt concentrations coupled with high humidity.

TABLE A

| Specimens | HOURS 24 | 44 | 68 |
|---|---|---|---|
| (1) Zinc plated control | WCP | WCP | WCP and Red rust from penetration to substrate |
| (2) 50% zinc-iron alloy 50% zinc | WCP | WCP | WCP and stain No penetration to substrate |
| (3) Multiple deposit composition agitation/no agitation 4 layers | WCP and Stain | WCP and severe stain | Not tested |

TABLE B

| SYSTEM | | HOURS EXPOSURE 6 | 18 | 24 | 30 | 42 | 48 | 54 |
|---|---|---|---|---|---|---|---|---|
| 0.1 mil zinc deposit | | | 8pR | 30pR | | | | |
| 0.3 mil zinc deposit | | | 0* | 0 | | 0 | 3pR | 24pR |
| 0.1 mil zinc-nickel | | 0 | | 0 | 8pR | | 35pR | |
| No agitation | 13.4% nickel | | | | | | | |
| Air agitation | 7.7% nickel | | | | | | | |
| No agitation | 13.4% nickel | | | | | | | |
| Air agitation | 7.7% nickel | | | | | | | |
| 0.1 mil zinc-nickel | | | 0 | 0 | | 12pR | | |
| No agitation | 10.9% nickel | | | | | | | |
| Air agitation | 3.8% nickel | | | | | | | |
| No agitation | 10.9% nickel | | | | | | | |
| Air agitation | 3.8% nickel | | | | | | | |

*Numbers denote the count of failure points on penetration to substrate. Therefore, "0" means no failure points were observed.
pR - pinpoint rust All tests are reported in accordance with ASTM Standard B537, and as is known, the legend zero signifies a complete failure and the number ten a specimen free of base metal corrosion. The formulations employed in preparation of panels used in corrosion exposure testing were basically the same as above discussed in connection with the neutral salt spray tests.

Referring first to Table C, it will be noted that the 0.1 mil zinc panels showed significant failure after about 2 months exposure, and 0.3 mil zinc panels underwent slight deterioration after 2 months to the end of this particular test at 12 months. Had this period been extended therebeyond, complete failure could be anticipated. Quite by contrast, the duplex panels of this invention, the only formulation difference therebetween being the nickel content, had a top rating up to the end of the 8 month period, and then showed a failure reading.

Table D below sets forth marine corrosion exposure test results over differing periods with alloy formulations varying somewhat over those of the last discussed Table. Again, it is quite clear from a study of this test data that panels prepared by applicant's herein disclosed procedures and carrying thereon zinc alloy electroplated coatings out-performed the prior art simple zinc electroplates of the same or even greater thicknesses.

Table E appearing hereinafter likewise shows the superiority of the present invention in an eleven month exposure test. The 0.1 mil zinc specimens were complete failures, and even tripling the zinc coating gave a reading of only 3. On the other hand, a multiple zinc-nickel coating using varying degrees of agitation scored the highest possible rating of 10.

TABLE C

CORROSION EXPOSURE RESULTS

| SYSTEM | LENGTH OF EXPOSURE 2 months | 5 months | 8 months | 12 months |
|---|---|---|---|---|
| 0.1 mil zinc | 4–5 | 0 | 0 | 0 |
| 0.3 mil zinc | 10 | 9.5 | 9.5 | 6 |
| 0.05 mil Zn-Ni (6%) plus 0.05 mil zinc | 10 | 10 | 10 | 0 |
| 0.05 mil Zn-Ni (9%) plus 0.05 mil zinc | 10 | 10 | 10 | 0 |

TABLE D

CORROSION EXPOSURE RESULTS

| System | Length of Exposure 3 to 5 Months | 8 to 9 Months | 12 Months |
|---|---|---|---|
| 0.1 mil zinc | 6 | 0 | 0 |
| 0.3 mil zinc | 9.5 | 9.5 | 6 |
| 0.05 mil Zn-Ni (5.7%) 0.05 mil Zinc | 10 | 10 | 0 |
| 0.05 mil Zn-Ni (9.7%) 0.05 mil Zinc | 10 | 10 | 0 |
| 0.05 mil Zn-Ni (9.2%) 0.05 mil Zinc | 10 | 5 | 3 |
| 0.05 mil Zn-Ni (13.3%) 0.05 mil Zinc | 10 | 7 | 6 |
| 0.05 mil Zn-Ni (19.8%) 0.05 mil Zinc | 8 | 0 | 0 |
| 0.05 mil Zn-Co (7.6%) | | | |

TABLE D-continued

| CORROSION EXPOSURE RESULTS | | | |
|---|---|---|---|
| | Length of Exposure | | |
| System | 3 to 5 Months | 8 to 9 Months | 12 Months |
| 0.05 mil Zinc | 10 | 10 | 0 |

TABLE E

| CORROSION EXPOSURE RESULTS EXPOSURE PERIOD - APPROXIMATELY 11 MONTHS | | |
|---|---|---|
| SYSTEM | | RATING |
| 0.1 mil zinc | | 0 |
| 0.3 mil zinc | | 3 |
| 0.2 mil Zn-Ni | 5.7% Ni | 10 |
| Zn-Ni | 4.3% Ni | |
| Zn-Ni | 5.7% Ni | |
| Zn-Ni | 4.3% Ni | |

It has been pointed out hereinabove that by proceeding in accordance with the novel concepts of this invention there may be provided an ultimate article which includes as a substrate a steel or iron-based alloy having electroplated thereupon one or more superimposed coatings containing zinc alloying elements located intermediate the base or substrate and a sacrificial layer of generally pure zinc. Of course, upon the latter layer there may be provided a passive film in the form of a chromate salt. In this manner markedly superior corrosion protective properties are imparted to the base or substrate and penetration of rust inducing substances into the metal bearing surfaces is effectively precluded under substantially all environmental conditions normally encountered, and simultaneously substantial production economies are effective. It is an important aspect of this invention that in the ultimate article produced there be provided a multi-layer deposit which contains two or more layers of zinc or zinc alloys in which the alloying elements are nickel, iron or cobalt, and also in which in any two consecutive layers the initial layer has a higher alloy content than any subsequent coatings electrodeposited thereupon, and further, by this same invention the alloy content of the initial layer does not exceed more than about 15% of iron, cobalt or nickel. Experience to date has indicated that when the initial layer of the zinc alloy deposit, whether the alloying element be nickel, cobalt or iron, is substantially less than about 3% of the alloying element or is greater than approximately 15% of the alloying element, the important advantages of superior corrosion protection at reduced production economies do not prevail. This is believed quite well indicated when reference is made to Table D hereinabove, which portrays that when under corrosion exposure exceeding about 9 months and a nickel alloying content of greater than about 15.0% there was substantial deterioration of the specimens. It is accordingly highly desirable for reasons of cost economies and high corrosion protective resistance that the amount of the alloying element, whether it be nickel, iron or cobalt, be within the range of approximately 3 to 15%.

It will be noted from the data presented hereinabove that the second layer in the novel article covered by the instant inventive concept has a second layer which contains at least 1.4% less in the amount of alloying element when compared with the initial layer. As to the element nickel, reference is made to Examples II, III and IV. Cobalt may also be one of the alloying elements, and the amount utilized in pursuit of this invention is revealed in Example VI. In each of the examples mentioned, by ready calculations, the alloying element is at least 1.4% less when comparison is made with the initial layer. In Table A the zinc-iron content is noted, and reference thereto is also made on pages 8 and 9 of the specification. Table E also makes reference to the novel concept in the present invention of the combination of zinc and nickel.

The contribution made by applicant is quite distinct from an article such as would be obtained when teachings from the galvanizing art are followed. Applicant is aware of U.S. Pat. Nos. 308,447; 1,468,905 and others, and as is typical of any product in the galvanizing area, intermediate the iron base and the upper zinc coat there must necessarily be a zinc-iron composition of quite varying content and thickness in which the zinc diffuses into the iron. The predictability of the relative zinc to iron content would seem to be impossible. Applicant on the other hand has upon the iron base a zinc-iron content of a specific amount and the amount of the alloying element in the superimposed layer is clearly controlled and predictable. There is no diffusion when one follows the novel concepts of the present invention.

The novel results achieved above have been particularly directed to the utilization of electroplating methods. However, and as was earlier noted, it is also within the contemplation of this invention that improvements may be achieved in the resistance of a metal-bearing surface to corrosion-inducing substances by applying to the surface through spraying techniques one or more superimposed coatings containing zinc alloying elements located intermediate the metal-bearing surface and a specified layer of generally pure zinc, the latter of which may be deposited by spraying, painting or electroplating methods. An effective technique which may be utilized is described in a publication entitled "Protective Coatings for Metal" authored by Burns and Bradley, published in 1955 by Reinhold Publishing Co., and particularly in Chapter Four bearing a title of "Sprayed Metal Coatings". Quite obviously, the process described in this publication has application with the present invention, and by proceedng in accordance with the teachings therein, ready control may be effected as to the amount of the zinc alloying element to be used in the practice of this invention.

Various modifications have been discussed herein as to the compositions and procedures of this invention, and changes and modifications therein may of course be effected without departing from the spirit of this invention or the scope of the subjoined claims.

What is claimed is:

1. A method for the production of a corrosion-resistant article which comprises subjecting a metal-bearing surface of steel or iron-based alloys to electroplating in a zinc-alloy electroplating bath to form on said surface a zinc-alloy deposit which contains from about 3 to 15% of an alloying element selected from the group consisting of nickel, iron, cobalt and mixtures thereof, the remainder of said alloy being zinc, and, thereafter, electroplating on said initial zinc-alloy coating a second zinc electrodeposit in which the content of the said alloying elements is at least 1.4% less than the content of the alloying elements in the said first deposit, the remainder of said alloy being zinc.

2. The method as claimed in claim 1 wherein both the initial and second electrodeposits are produced from the same zinc-alloy electroplating bath and the amount of agitation of the bath is varied during electrodeposition to control the amount of alloying element deposited in each electrodeposited coating.

3. The method as claimed in claim 1 wherein the second electrodeposited coating is substantially pure zinc.

4. The method as claimed in claims 2, 3, or 1 wherein a chromate salt passive film is applied on top of the second electrodeposited coating.

* * * * *